US007101832B2

(12) United States Patent
Asher et al.

(10) Patent No.: US 7,101,832 B2
(45) Date of Patent: Sep. 5, 2006

(54) CLEANERS CONTAINING PEROXIDE BLEACHING AGENTS FOR CLEANING PAPER MAKING EQUIPMENT AND METHOD

(75) Inventors: Vikram Asher, Cincinnati, OH (US); Robert E. Ebbeler, Cincinnati, OH (US)

(73) Assignee: JohnsonDiversey, Inc., Sturtevant, WI (US)

( * ) Notice: Subject to any disclaimer, the term of this patent is extended or adjusted under 35 U.S.C. 154(b) by 298 days.

(21) Appl. No.: 10/465,248

(22) Filed: Jun. 19, 2003

(65) Prior Publication Data

US 2004/0259745 A1 Dec. 23, 2004

(51) Int. Cl.
*C11D 9/00* (2006.01)
*C11D 9/42* (2006.01)

(52) U.S. Cl. ..... 510/170; 510/171; 510/172; 510/173; 510/174; 134/103.1

(58) Field of Classification Search ..... 162/5, 162/8, 6, 72, 4, 7; 510/174, 421, 372; 252/60
See application file for complete search history.

(56) References Cited

U.S. PATENT DOCUMENTS

| | | | | | |
|---|---|---|---|---|---|
| 4,008,167 | A | | 2/1977 | Nakagawa et al. | 252/99 |
| 4,372,813 | A | | 2/1983 | Clerbois et al. | 162/48 |
| 4,510,068 | A | | 4/1985 | Rohlfs et al. | 252/186.29 |
| 4,732,650 | A | | 3/1988 | Michalowski et al. | 162/17 |
| 4,900,468 | A | | 2/1990 | Mitchell et al. | 252/95 |
| 4,963,157 | A | | 10/1990 | Machida et al. | 8/111 |
| 4,971,656 | A | * | 11/1990 | Lehmann et al. | 162/5 |
| 5,045,296 | A | | 9/1991 | Pfeffer et al. | 423/415 P |
| 5,118,436 | A | | 6/1992 | Aoyagi et al. | 252/99 |
| 5,164,234 | A | | 11/1992 | Siebert | 427/419.8 |
| 5,180,514 | A | | 1/1993 | Farr et al. | 252/99 |
| 5,259,969 | A | * | 11/1993 | Srivatsa et al. | 252/60 |
| 5,290,361 | A | | 3/1994 | Hayashida et al. | 134/2 |
| 5,362,363 | A | * | 11/1994 | Smolka et al. | 162/8 |
| 5,370,770 | A | * | 12/1994 | Johnson et al. | 162/6 |
| 5,411,673 | A | | 5/1995 | Agar et al. | 252/95 |
| 5,417,807 | A | * | 5/1995 | Fossas et al. | 162/5 |
| 5,464,563 | A | | 11/1995 | Moore et al. | 252/186.29 |
| 5,616,280 | A | | 4/1997 | Moore et al. | 252/186.29 |
| 5,651,861 | A | * | 7/1997 | Larson et al. | 162/5 |
| 5,670,082 | A | | 9/1997 | Stechlin et al. | 252/186.42 |
| 5,705,466 | A | | 1/1998 | Baillely et al. | 510/312 |
| 5,712,234 | A | * | 1/1998 | Pourreau | 510/174 |
| 5,739,095 | A | | 4/1998 | Langguth et al. | 510/367 |
| 5,762,757 | A | | 6/1998 | Nguyen et al. | 162/158 |
| 5,786,315 | A | | 7/1998 | Sadlowski | 510/230 |
| 5,792,738 | A | | 8/1998 | Baillely et al. | 510/375 |
| 5,855,622 | A | | 1/1999 | Takeuchi | 8/111 |
| 5,872,092 | A | | 2/1999 | Kong-Chan et al. | 510/413 |
| 5,891,837 | A | | 4/1999 | Baillely et al. | 510/309 |
| 5,900,256 | A | | 5/1999 | Scoville, Jr. et al. | 424/616 |
| 5,914,304 | A | | 6/1999 | Croud et al. | 510/367 |
| 5,922,083 | A | | 7/1999 | Biscarini et al. | 8/137 |
| 5,964,960 | A | | 10/1999 | Boeck | 134/34 |
| 5,977,044 | A | | 11/1999 | Peterson et al. | 510/277 |
| 5,997,764 | A | | 12/1999 | Ambuter et al. | 252/186.25 |
| 5,998,350 | A | | 12/1999 | Burns et al. | 510/320 |
| 6,007,680 | A | | 12/1999 | Carlsson et al. | 162/252 |
| 6,013,157 | A | * | 1/2000 | Li et al. | 162/5 |
| 6,043,209 | A | | 3/2000 | Micciche et al. | 510/280 |
| 6,113,654 | A | | 9/2000 | Peterson | 8/137 |
| 6,140,294 | A | | 10/2000 | Delroisse et al. | 510/309 |
| 6,155,912 | A | | 12/2000 | Chen et al. | 451/56 |
| 6,183,708 | B1 | | 2/2001 | Hei et al. | 423/210 |
| 6,187,738 | B1 | | 2/2001 | Micciche et al. | 510/278 |
| 6,218,351 | B1 | | 4/2001 | Busch et al. | 510/311 |
| 6,228,179 | B1 | | 5/2001 | Morinaga | 134/2 |
| 6,235,699 | B1 | | 5/2001 | Del Duca et al. | 510/375 |
| 6,241,779 | B1 | | 6/2001 | Collins et al. | 8/111 |
| 6,274,542 | B1 | | 8/2001 | Carr et al. | 510/376 |
| 6,312,670 | B1 | | 11/2001 | Montgomery | 424/53 |
| 6,323,169 | B1 | | 11/2001 | Abe et al. | 510/176 |
| 6,331,292 | B1 | | 12/2001 | Montgomery | 424/53 |
| 6,387,858 | B1 | | 5/2002 | Shah et al. | 510/161 |
| 6,402,891 | B1 | | 6/2002 | Asher et al. | 162/199 |
| 6,426,200 | B1 | * | 7/2002 | Yang et al. | 435/72 |
| 6,488,914 | B1 | | 12/2002 | Montgomery | 424/53 |
| 6,514,543 | B1 | | 2/2003 | Montgomery | 426/53 |
| 6,544,383 | B1 | * | 4/2003 | Robinson et al. | 162/5 |

(Continued)

FOREIGN PATENT DOCUMENTS

| | | |
|---|---|---|
| DE | 19528843 | 2/1997 |

OTHER PUBLICATIONS

Bryant, C.W.; Avenell, J.J.; Barkley, W.A.; Thut, R.N., *The removal of chlorinated organics from conventional pulp and paper wastewater treatment systems*. Water Sci. Technol. (1992), 26(1-2, Water Qual. Int. '92, Pt. 1), 417-25 Abstract Only.

*Primary Examiner*—Gregory Webb
(74) *Attorney, Agent, or Firm*—Wood, Herron & Evans, L.L.P.

(57) ABSTRACT

A cleaning solution for paper making equipment includes a stabilized source of peroxide in combination with a glycol ether solvent system and an alcohol ethoxylate. The peroxide system can be hydrogen peroxide stabilized with a phosphonate such as HEDP. The glycol solvent system may be a propylene glycol ether such as dipropylene glycol methylether or tripropylene glycol methylether. This solution can be formulated with a pH from about 4 to about 12. This is used by recirculating it through a paper making equipment during a shut down procedure.

9 Claims, No Drawings

U.S. PATENT DOCUMENTS

2002/0061283 A1 5/2002 Montgomery
2002/0064564 A1 5/2002 Montgomery
2002/0068041 A1 6/2002 Montgomery
2002/0098697 A1 7/2002 Shimazu et al.
2002/0114757 A1 8/2002 Tenney et al.
2002/0127281 A1 9/2002 Tsao
2002/0174500 A1* 11/2002 Micciche et al. ..... 15/104.93
2003/0021853 A1 1/2003 Wei et al.
2004/0186037 A1* 9/2004 Cheung et al. ..... 510/426

* cited by examiner

CLEANERS CONTAINING PEROXIDE BLEACHING AGENTS FOR CLEANING PAPER MAKING EQUIPMENT AND METHOD

BACKGROUND OF THE INVENTION

Pulp used to form paper contains a number of impurities which tend to deposit on the paper making equipment. One such impurity is "pitch" which refers to deposits originating from natural resins and their salts. Stickies is a term that refers to hydrophobic components used in the manufacture of a paper product. Stickies arise from residues of polymers that are used in retention aids, drainage aids, adhesives, ink resins and coatings used in various processes of making paper. The term "stickies" has increasingly been used to describe deposits that occur in systems using recycled fiber.

Although paper manufacturers go to great lengths to prevent pitch and sticky deposits on the paper making equipment as well as the deposition of other unwanted material such as dirt, grime and the like, eventually the equipment must be cleaned.

Current commercial cleaners generally are very alkaline and/or chlorine-containing (i.e., chlorine bleaches) chemical compositions. They can be used in a variety of different manners including a boil-out procedure where the hot cleaning solution is circulated through the paper making equipment, or can be sprayed directly onto equipment.

With either type of solution, worker safety is an issue. Further, waste disposal is a problem. The highly caustic material must be neutralized prior to disposal. This requires highly acidic mineral acids and presents additional safety concerns. Chlorine-containing compositions present additional environmental concerns.

SUMMARY OF THE INVENTION

The present invention is premised on the realization that a non-chlorinated cleaning composition can effectively clean paper making equipment and coating systems. More particularly, an aqueous composition which contains a stabilized hydrogen peroxide, glycol ether solvent in combination with a non-ionic surfactant, acts to effectively clean paper making equipment using a boil-out procedure. More particularly, the present invention is premised on the realization that the combination of hydrogen peroxide, a phosphonate, a glycol ether solvent and an ethoxylated alcohol non-ionic surfactant effectively cleans paper making equipment. The objects and advantages of the present invention will be further appreciated in light of the following detailed description.

DETAILED DESCRIPTION OF THE INVENTION

The cleaning solution of the present invention is effective to clean paper making equipment and coating systems. The cleaning solution of the present invention is an aqueous based solution which includes a stabilized peroxide solution in combination with a glycol ether solvent and an non-ionic surfactant.

The peroxide source can be either an aqueous solution of hydrogen peroxide or peroxygen salts or organic peroxide salt. Generally a hydrogen peroxide solution is employed. This can be used in commercially available concentrations of about 35%. The solution should contain 3% to 4% hydrogen peroxide active component which is from about one to about ten percent of a commercial hydrogen peroxide solution (35% $H_2O_2$). The use concentration of peroxide should be at least about 50 ppm or higher.

The peroxide is stabilized by the addition of a phosphonate. A wide variety of phosphonates can be employed. These are derivatives of phosphonic acid such as 1-hydroxyethylidene-1-diphosphonic acid, aminotrimethylene phosphonic acid, as well as others. One preferred diphosphonate is HEDP sold as Dequest 2010. The phosphonate should be present in an amount of from about 1% to about 10% on a solids basis. Preferably about 5% of the Dequest 2010 is employed which is 58% to 62% actives which provides about 3% active. The use concentration should be about 1.5 ppm to 150 ppm.

The composition further includes a glycol ether solvent system. This should be in an amount effective to basically dissolve the pitch and stickies present on the equipment. A wide variety of different glycol ethers can be employed including propylene glycol methylether, dipropylene glycol methylether, tripropylene glycol methylether, propylene glycol methylether acetate, dipropylene glycol methylether acetate, propylene glycol n-butylether, dipropylene glycol n-butyl ether, propylene glycol n-propylether, dipropylene glycol n-propylether, tripropylene glycol n-butylether, ethylene glycol n-butylether, diethylene glycol butylether, trimethylene glycol n-butylether, and higher homologues, diethylene glycol methylether, trimethylene glycol methylether, and higher homologues, as well as combinations of these. A combination can be employed to provide better solvency. One combination which is particularly effective is the combination of dipropylene glycol methylether and tripropylene glycol methylether. Basically, these should be present in an amount from about 1 to 20% combined by weight. A preferred formulation includes 1% dipropylene glycol methyether and 1% tripropylene glycol methylether. A preferred source for this is the Dowanol series of glycol ethers. The use concentration of the glycol ether solution should be about 0.5 ppm to about 50 ppm.

In addition to the above, the present formulation further includes an effective amount of a non-ionic surfactant. Preferably the non-ionic surfactant is an alcohol ethoxylate or an alkylphenol ethoxylate. The alcohol ethoxylates are the condensation products of aliphatic alcohols with ethylene oxide. The alcohol chain of the aliphatic alcohol may be either straight or branched and generally contains 8 to 22 carbon atoms. Linear primary alcohol ethoxylates are particularly useful in the present invention and contain an alcohol chain length of $C_6$–$C_{18}$ with 2.5 to 15 ethylene oxide groups per molecule. One preferred non-ionic is Neodol 91-8 which has a $C_9$–$C_{11}$ primary alcohol chain with approximately 8 moles of ethylene oxide per mole of $C_{9\text{-}11}$ alcohol. A preferred alkylphenol ethoxylate is nonylphenol ethoxylate The primary limitation on the non-ionic surfactant is that is must be water dispersible and preferably water soluble. This will be present in an amount of from about 1% up to about 10%, with about 2% being preferred. At this amount the nonionic surfactant effectively assists in wetting, cleaning and emulsification of typical soils encountered in a paper mill.

In addition to the above, the formulation will include an effective amount of a base to establish the desired pH range. The desired pH range will be from about 4 to about 12. The phosphonate is generally acidic. Adequate base, such as sodium hydroxide or potassium hydroxide is added to the composition to modify the acidity. The acidity would be maintained in the acid range where the papermaking equipment was experiencing calcium carbonate build up. The acidity would effectively dissolve the calcium carbonate. However, where the paper making equipment is subjected to build up of polymers such as polyvinyl acetate, a more basic pH would be employed and thus more base would be added.

The composition should start out with the desired amount of water which will form from about 50 to about 80% of the composition. The remaining components can be added in any particular order with the peroxide preferably added last.

To use the formulation of the present invention this would be diluted to use concentrations, generally 0.5 to 50% by weight and introduced to paper making machinery during a shut down period. The formulation then would be circulated through the system at a temperature of from about room temperature, i.e., about 20° C., up to about 60° C. This is continued for the required period of time and the solution is then removed and either discarded or returned to a holding tank for subsequent use. The formulation can also be used at 100% concentration and applied directly to the machinery.

The invention will be further appreciated in light of the following detailed example.

DETAILED EXAMPLE

The following cleaning formulation was prepared:

| | | Actives |
|---|---|---|
| water | 78.8% | 88.3% |
| Dequest 2010 | 5% | 3% |
| 45% aqueous potassium hydroxide | 3.6% | 1.62% |
| Dowanol DPM | 1% | 1% |
| Dowanol TPM | 1% | 1% |
| Neodol 91-8 | 2% | 2% |
| hydrogen peroxide (35% solution) | 8.6% | 3.01% |

Example 1

Wash Study of Coated Panels

Steel panels were coated with the sample of a coating blend provided by the mill. The coated panels were air dried for 24 hours followed by baking in an oven at 100 C/212 F for 24 hrs.

They were soaked in the cleaning solution at 40 C/104 F for 20–25 minutes and rinsed with cold tap water.

Panels soaked in a 5% solution of the above cleaning formulation, in combination with 0.5% of liquid caustic removed approximately 60% of the coated material. Panels soaked in 2% of the above material with 0.5% of liquid caustic removed approximately 50% of the coating, and panels soaked in 2% of the above cleaning formulation without caustic removed approximately 4% of the coating.

Example 2

Wash Study of Coated Panels

Steel panels were coated with residues of various samples of a coating blends provided by different mills. The panels were air dried for 24 hours followed by baking in an oven at 100 C/212 F for one month.

They were soaked in the cleaning solution at 40 C/104 F for 30 minutes and rinsed with cold tap water.

The coating blend was primarily formed from polymer impurities such as polyvinyl alcohol and polyvinyl acetate. Accordingly, this demonstrates the benefit of utilizing a basic cleaning solution.

Panels soaked in 5% of the above cleaning formulation with 0.5% of liquid caustic removed approximately 95% of the material.

Example 3

Wash Study of Coated Panels

Panels coated with residues from a paper mill were baked to dry the residues on the panels. The panels were then soaked in 5% solution of the above cleaning formulation. The pH of this wash solution was between 4–5. The residue which was supplied by the mill, contained a significant amount of calcium carbonate. The mildly acidic cleaning solution was effective in cleaning the panels that were soaked in this solution. Approximately 95–100% of the coating was removed as determined by the loss in weight of the coating before and after soaking in the test solution.

As shown from the above, the formulation of the present invention effectively cleans paper making equipment without reliance on chlorinated chemicals. Further, it permits the pH of the solution to be modified to effectively treat a variety of different conditions.

This has been a description of the present invention along with the preferred method of practicing the present invention. However, the invention itself should only be defined by the appended claims wherein we claim:

The invention claimed is:

1. A method of cleaning paper making equipment comprising recirculating through said paper making equipment a cleaning composition comprising an aqueous solution of a stabilized peroxide in combination with a glycol ether solvent system and a non-ionic alcohol ethoxylate surfactant.

2. The method claimed in claim 1 wherein said peroxide comprises hydrogen peroxide.

3. The method claimed in claim 1 wherein said cleaning composition further includes an amount of a phosphonate effective to stabilize said peroxide.

4. The method claimed in claim 2 wherein said glycol ether solvent system is selected from the group consisting of propylene glycol methylether, dipropylene glycol methylether, tripropylene glycol methylether, propylene glycol methylether acetate, dipropylene glycol methylether acetate, propylene glycol n-butylether, dipropylene glycol butylether, propylene glycol n-propylether, dipropylene glycol n-propylether, tripropylene glycol n-butylether, ethylene glycol n-butylether, diethylene glycol butylether, trimethylene glycol n-butylether, diethylene glycol methylether, trimethylene glycol methylether, and combinations of these.

5. The method claimed in claim 4 wherein said glycol ether solvent system comprises a combination of dipropylene glycol methylether and tripropylene glycol methylether.

6. The method claimed in claim 4 wherein said cleaning composition comprises water, HEDP (1.5 ppm to 15 ppm), dipropylene glycol methylether (0.5 ppm to 50 ppm), tripropylene glycol methylether (0.5 ppm to 50 ppm), water soluble alcohol ethoxylate (1 ppm to 100 ppm), peroxide (150 ppm to 1500 ppm).

7. A method of cleaning paper making equipment comprising recirculating through said paper making equipment a cleaning composition comprising an aqueous solution of a stabilized peroxide in combination with a non-ionic alcohol ethoxylate surfactant and a combination of di-propylene glycolmethyl ether and tri-propylene glycolmethyl ether.

8. A method of cleaning paper making equipment comprising recirculating through said paper making equipment a cleaning composition comprising HEDP (1.5 ppm to 15 ppm), di-propylene glycolmethyl ether (0.5 ppm to 50 ppm), tri-propylene glycolmethyl ether (0.5 ppm to 50 ppm), water soluble alcohol ethoxylate (1 ppm to 100 ppm), and a peroxide (150 ppm to 1500 ppm).

9. A method of cleaning paper making equipment comprising applying onto surfaces of said paper making equipment a cleaning composition comprising an aqueous solution of a stabilized peroxide in combination with a glycolether solvent system and a nonionic alcohol ethoxylate surfactant.

* * * * *